United States Patent [19]

Komori

[11] Patent Number: 4,913,073

[45] Date of Patent: Apr. 3, 1990

[54] CLOTH PRESSER IN A SEWING MACHINE STITCHING IN ZIGZAG AND PROVIDED WITH THREAD END HOLDER

[75] Inventor: Norio Komori, Tochigi, Japan

[73] Assignee: SSMC Inc., Fairfield, N.J.

[21] Appl. No.: 354,955

[22] Filed: May 22, 1989

[30] Foreign Application Priority Data

Jun. 21, 1988 [JP] Japan ..... 63-81858

[51] Int. Cl.[4] ..... D05B 29/12; D05B 65/00

[52] U.S. Cl. ..... 112/235; 112/253; 112/295

[58] Field of Search ..... 112/235, 295, 296, 299, 112/285

[56] References Cited

FOREIGN PATENT DOCUMENTS 2646326 5/1978 Fed. Rep. of Germany ..... 112/299

*Primary Examiner*—Werner H. Schroeder
*Assistant Examiner*—David K. Suto
*Attorney, Agent, or Firm*—Theodore C. Jay

[57] ABSTRACT

The bottom plate of a cloth presser supporter is pivotally mounted on a lower end of the supporter adjacent a rear end of the plate. The plate has an L shaped slot, one slot leg being a needle location groove, the other slot leg being a needle thread guide. The plate has a knife receiving groove with a knife mounted therein. A thread holder holds the end of a thread vertically above the plate so that the thread when extended between the held thread end and the first zigzag stitch of the thread does not extend over a corner defined by the intersection of the side wall of one slot leg with the corresponding side wall of the other slot leg.

3 Claims, 5 Drawing Sheets

CLOTH PRESSER IN A SEWING MACHINE STITCHING IN ZIGZAG AND PROVIDED WITH THREAD END HOLDER

BACKGROUND OF THE INVENTION

1. Field of the Invention

The present invention relates to a cloth presser in a sewing machine stitching in zigzag and provided with a thread end holder capable of cutting the thread end used at the starting of sewing and remained on the surface of the sewn cloth.

2. Description of the Prior Art

In a prior art cloth presser in a sewing machine stitching in zigzag and provided with an automatic thread cutter having a movable knife inserted into a recess of a cloth presser bottom plate, a needle thread can be cut by the movable knife or manually at the completion of the sewing operation. If the new sewing operation is started at the state where an end of the thread is not held but left as it is, at a first stitch the needle penetrates the sewn cloth while the needle thread is hooked by a tip of a full rotatable hook under the sewn cloth. The thread end of the needle thread is drawn under the sewn cloth and tangled with the seams while it effects a couple of stitches to produce an inferior quality of the seam, the so-called waste or bird nest.

In the case where the end of the needle thread is pressed by the cloth presser at the start of sewing operation of the cloth, the thread end is not inserted under the sewn cloth. However, the thread end is retained longer on the upper surface of the sewn cloth which requires a step for cutting this retained thread to improve the quality.

In the case where no first stitch is formed on a cloth to be sewn, the so-called empty sewing, the thread end is not subject to increased friction caused by the cloth so that the needle thread slips off from the needle hole and the cloth can not be sewn.

To solve the problem of inconvenience at the start of sewing operation, there is disclosed a means for holding the thread end of the needle thread in Japanese Utility Model Laid-Open Publication No. 58-5592 which is illustrated in FIG. 9. In FIG. 9, both a hook a provided at the tip end of an elastic metal lever b which is reciprocally and swingably driven by a rotary solenoid S and a presser lever 13 are moved toward the tip of needle threads B hung down from needles A and moved backward while holding the end of the needle threads B.

Japanese Utility Publication No. 58-5592 solves the problem of inconvenience created by the free end of the needle thread. However, is needed a finishing step for cutting the remained thread since greater force affects the thread extended between the thread end holder and the seam made by the first stitch, and the thread slips off from the thread end holder and retained on the sewn cloth.

Japanese Utility Model Laid-Open Publication No. 62-109079 discloses a cloth presser in a sewing machine provided with a thread end holder for preventing the thread end at the start of the sewing operation from being retained on the surface of the sewn cloth for a long time. However, this invention is difficult to use directly on a cloth presser in a sewing machine stitching in zigzag and provided with a thread end holder in which the needle position is varied, since it thread is difficult to cut the needle thread with safety.

SUMMARY OF THE INVENTION

It is therefore an object of the present invention to provide a cloth presser in a sewing machine stitching zigzag which is provided with thread end holder capable of eliminating the laborious working to cut the thread in a separate finishing process.

It is a second object of the present invention to provide a cloth presser in a sewing machine stitching zigzag which is provided with thread end holder capable of guiding the extension thread into the guide groove whereby the thread end of the needle thread can be surely cut.

To achieve the above object, the present invention is directed toward cloth presser adapted for use in a sewing machine stitching in zigzag which comprises:

a cloth presser supporter having upper and lower ends;

a cloth presser bottom plate adapted to be moved in a cloth feeding direction, the plate having front and rear ends and being pivotally mounted on the lower end of the supporter in a region adjacent the rear end of the plate, the plate having an L shaped slot, one leg of the slot being disposed at right angles to said direction, the other leg of the slot extending rearwardly from the said one leg at right angles thereto, the one leg being designated as a needle location groove, the other leg being designated as a needle thread guide, the region at which the side wall of the one leg remote from the front end of the plate intersects the corresponding side wall of the other leg defining a corner, said plate also being provided with a flat knife receiving groove adjacent the rear end of the plate, said knife groove extending parallel to but spaced rearwardly from the needle location groove, said knife groove having a selected depth;

a thread holder for holding an end of a thread which has been previously passed through a hole in a needle at a vertical separation with respect to the plate such that said thread when extended between the thread end held by the holder and the first zigzag stitch of said thread does not extend over the corner; and a flat knife disposed in said groove and secured to said plate, the thickness of the knife being equal to the depth of said knife groove.

This arrangement when in use will cut the thread in the manner previously set forth in the above recited objects of the invention.

The above and other objects, features and advantages of the present invention will become more apparent from the following description taken in conjunction with the accompanying drawings.

DESCRIPTION OF THE PREFERRED EMBODIMENT

Figure 1:
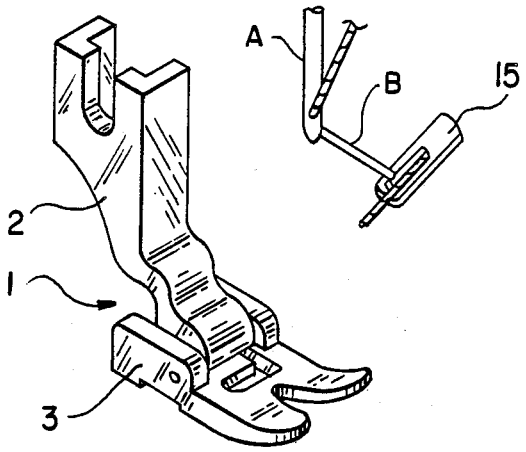
FIG. 1 is perspective view showing a cloth presser and a thread end holder in accordance with the present invention.

A preferred embodiment of the present invention will be described with reference to FIGS. 1 and 2.

A cloth presser 1 in a sewing machine stitching in zigzag and provided with a thread end holder comprises a cloth presser supporter 2, and a cloth presser bottom plate 3 pivotally mounted on the cloth presser supporter 2, a thread end holder 15 for holding an end of a thread B passed through a hole of a needle A, and a cutter 6.

Figure 2:
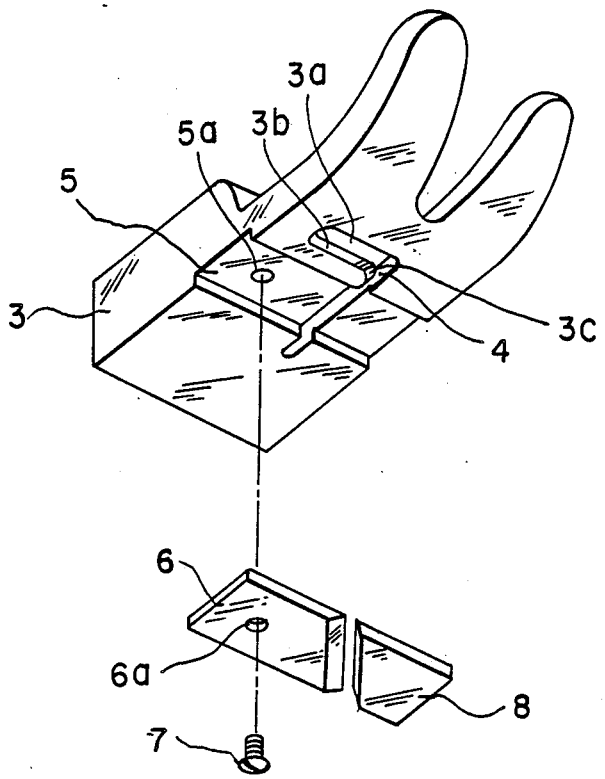
FIG. 2 is a perspective enlarged view the cloth presser bottom plate of the cloth presser of FIG. 1.
Figure 6:
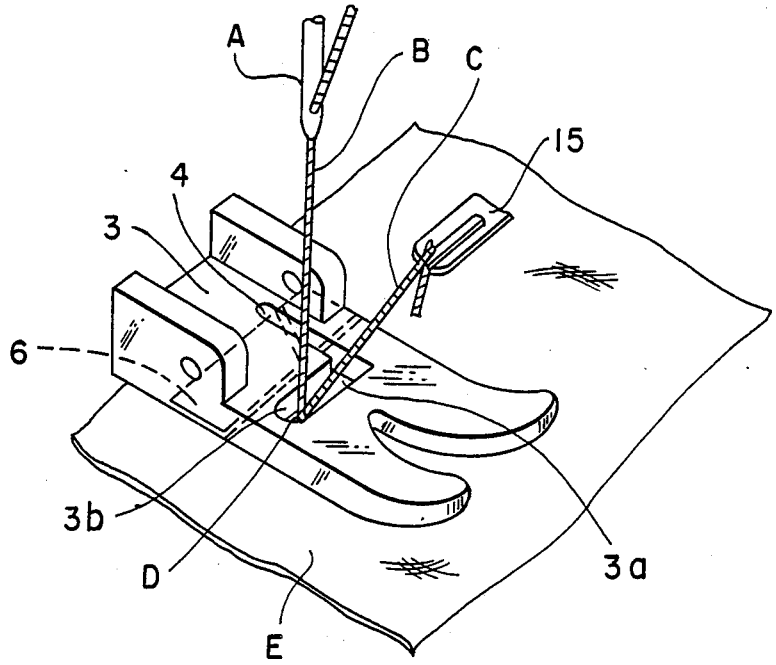

The cloth presser bottom plate 3, as illustrated in enlarged and view exploded in FIG. 2, comprises a needle location groove 3*a* extending perpendicular to the cloth feeding direction, a guide groove 4 extending from the needle location groove 3*a* at the side of the thread end holder 15 in the cloth feeding direction for guiding the needle thread B. The needle location groove 3*a* and the guide groove 4 are respectively provided by by a common L shaped slot in the cloth presser bottom plate 3. The height of the thread end holder 15 is, as illustrated in FIG. 6, set in the manner that a thread C extended between the thread end held by the thread end supporter 15 and a first stitched portion D of the zigzag stitch does not extend above flank wall 3*b* of the needle location groove 3*a* even if the first stitched portion D is formed at the portion remote from the thread end holder 15, namely at the left of the needle location groove 3*a*.

The cloth presser bottom plate 3 further comprises a round corner 3*c* defined by planing off a corner of the region 3*b* where the needle location groove 3*a* and the guide groove 4 are connected, namely, at the corner of a cutting edge of knife 6.

The lower surface of the cloth presser bottom plate 3 has a knife supporting groove 5 positioned parallel with the needle location groove 3*a*. The knife groove 5 has a threaded hole 5*a* thickness knife 6 having a same height of the depth as knife fixing groove 5 and a bore 6*a*. A set screw 7 is inserted through bore 6*a* and screwed into the threaded hole 5*a* to secure the knife 6 to the knife sharp groove 5. A share point of knife 6 positioned under the lower surface of the cloth presser bottom plate 3 crosses the guide groove 4. Knife 6 has a second separated knife section 8 disposed in groove 5. while interposing the guide groove 4 therebetween.

An operation of the cloth presser in a sewing machine stitching in zigzag and provided with thread end holder is described with reference to FIGS. 3 to 8.

Figure 3:
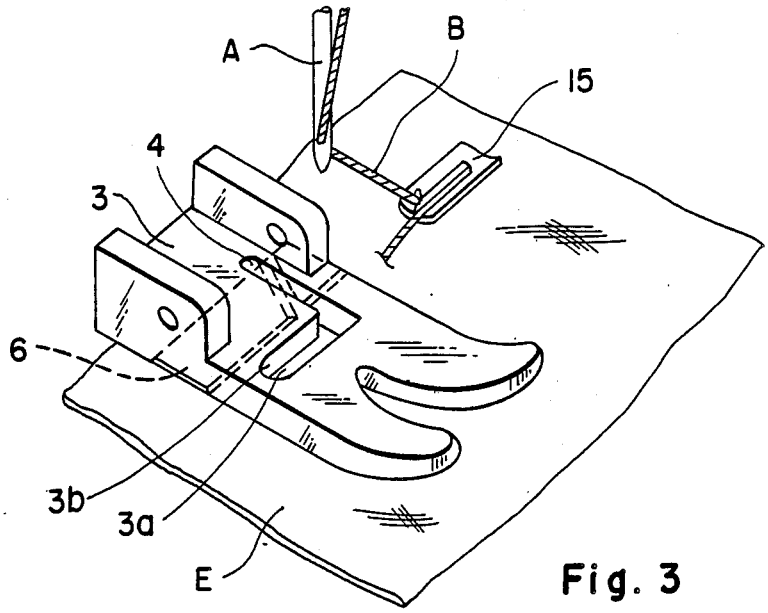
FIGS. 3, 4, 5, 6, 7 and 8 are views which provide assistance in explaining operations of the cloth presser and the thread end holder of FIG. 1.
Figure 4:
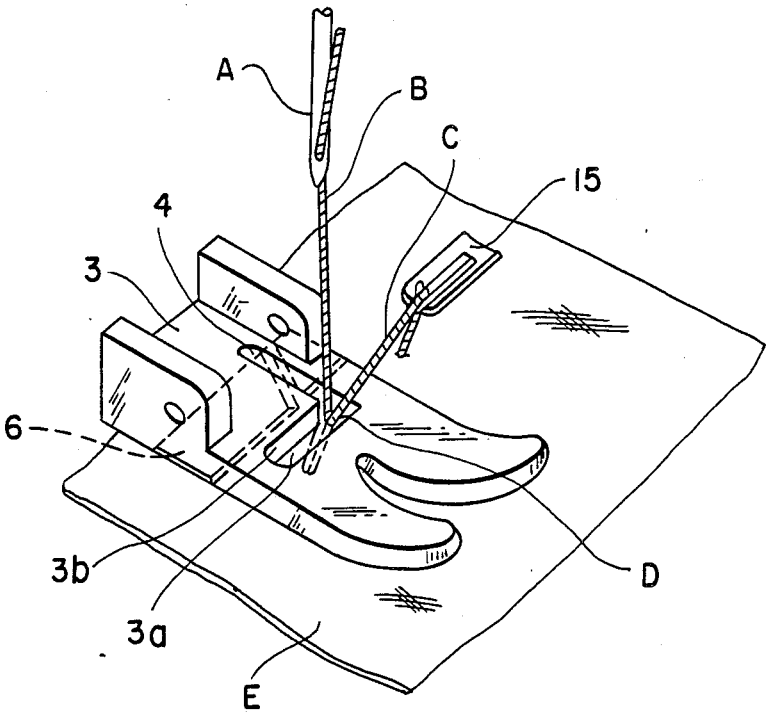

The needle A is positioned in a top dead point while the thread end holder 15 moves forwardly to hold a tip end of the needle thread B and backwadly. Designated at E is a cloth to be sewn as illustrated in FIG. 3.

The needle A drops in the needle location groove 3*a* at the side close to the thread end holder 15, namely at right side seen from the operator and a first stitch D is formed on the cloth to be sewn. An extension thread C is defined between the thread end held by the thread end holde 15 and the first stitch D. A second stitch is formed on the left of the needle location groove 3*a*, a third stitch on the right of the needle location groove 3*a*, and the successive stitches are alternately formed on the left and the right of the needle location groove 3*a*. Hence, the zigzag stitching is effected with the feeding of the cloth E. With the progress of the zigzag stitching operation, the extension thread C is guided into the guide groove C at the side close to the first stitch D while the end is kept held by the thread end holder 15. At this state, since the first stitch D is formed at the connection portion between the guide groove 4 and the needle position groove 3*a*, the first stitch D is guided smoothly into the guide groove 4 without engaging the corner of the connection portion.

Figure 5:
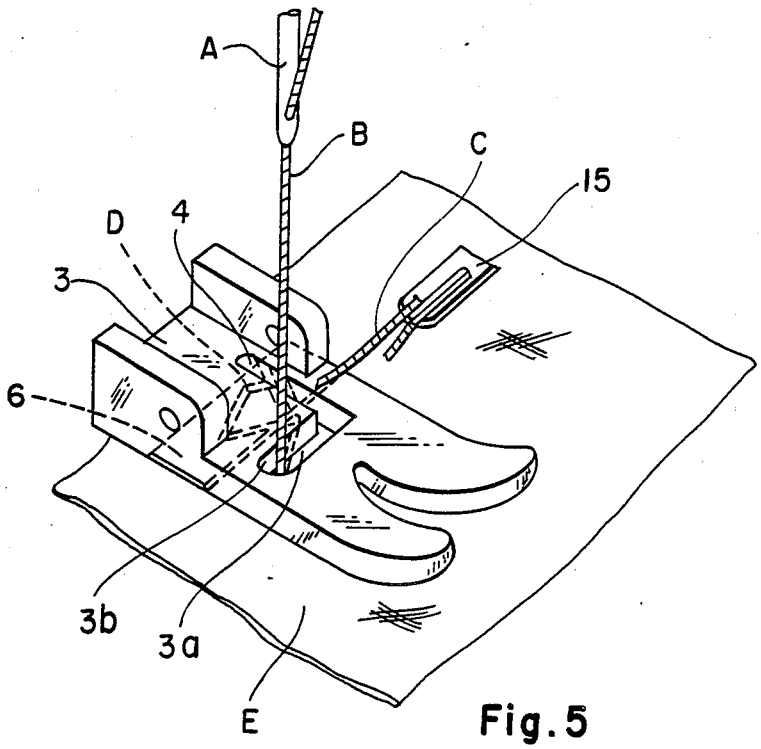

With further progress of the stitching operation as illustrated in FIG. 5, the first stitch D moves substantially on the central line of the guide groove 4 while the portion close to the first stitch of the extension thread C contacts substantially the central portion of the sharp point of the fixed knife 6 and is cut off.

Then, the case will be described where the first stich D of the zigzag stitch is formed in the needle location groove 31 at the side remote from the thread end holder 15, namely, at the left side viewed from the operator. At this state, the extension thread C is formed between the thread end held by the thread end holder 15 and the first stitch D as illustrated in FIG. 6.

Figure 7:
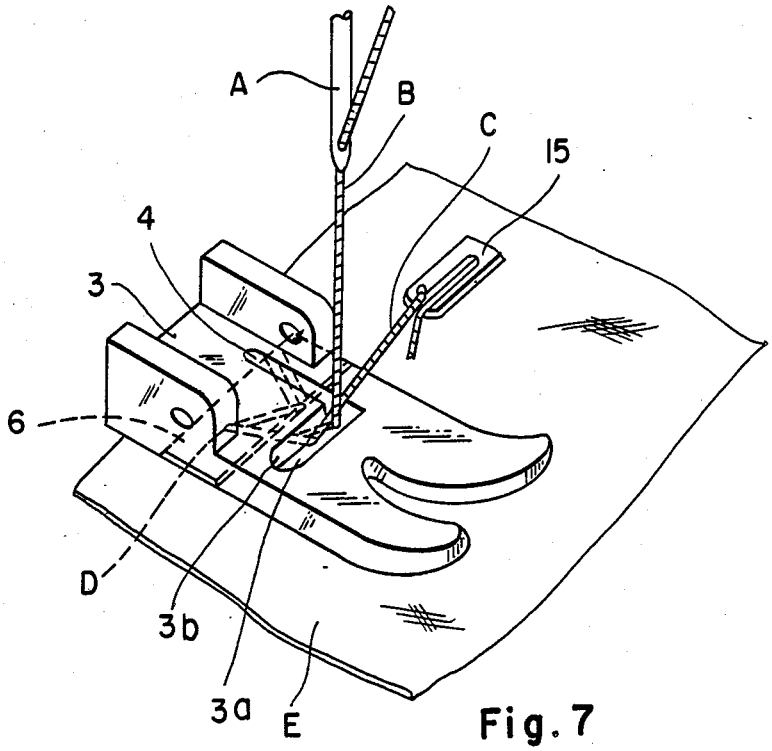

With the progress of the zigzag stitching operation, the portion close to the first stitch D of the extension thread C slides past the front side wall 3*b* of the needle location groove 3*a* and guided into the guide groove 4. Since the extension thread C is set not to pass over over the flank 3*b* having the rounded corner 3*c*, the extension thread C can be guided with ease into the guide groove 4 and positioned substantially across diagonal line of the guide groove 4 as shown in FIG. 7.

Figure 8:
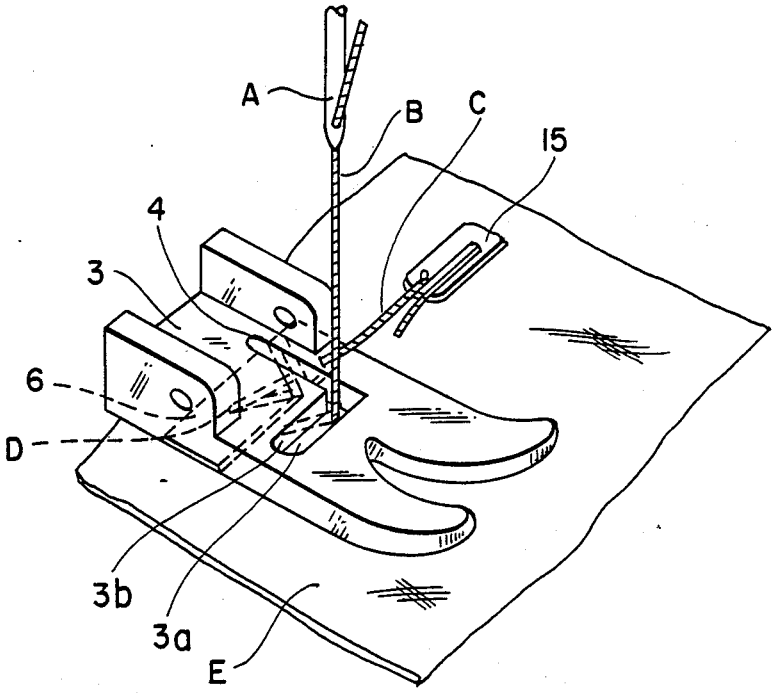
Figure 9:
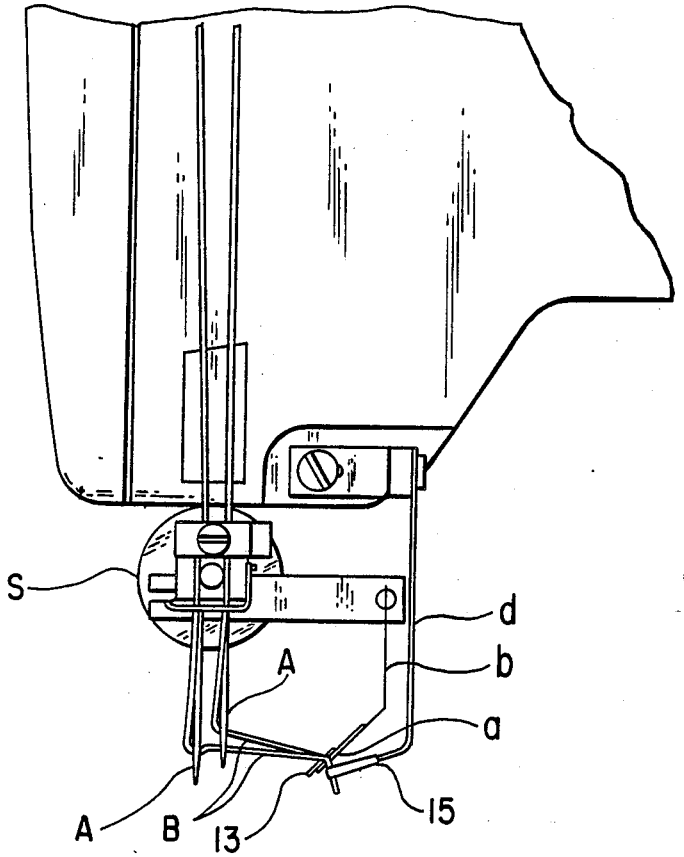
FIG. 9 is a view showing a prior art thread end holder.

With the progress of the zigzag stitiching operation as shown in FIG. 8, the portion closed to the first stitch D of the extension thread C contacts the sharp point of the fixed knife 6 and is cut off thereby.

The embeding plate 8 can serve to surely cut off the end of the needle thread B which is inserted into the guide groove 4 if the knife sections 6, 8 are open toward the needle location groove 3*a* and positioned to form a V-shape at the guide grove 4*a*.

With the arrangement of the cloth presser in a sewing machine stitching in zigzag and provided with a thread end holder, the following advantages are obtained.

(1) The inconveniences of start sewing caused by the free end of the thread end are all solved and the extension thread is cut at the portion adjacent to the first stitch so that the thread remained on the cloth to be sewn is shortened which eliminates the laborious working to cut the thread in a separate finishing process.

(2) Inasmuch as the extension thread extended between the thread end holder holding the thread end and the first zigzag stitch does not extend over the front side wall of the needle position groove, the extension thread can be surely guided into the guide groove whereby the thread end of the needle thread can be surely cut.

(3) Assuming that the two knife sections are provided in V-shape under the lower surface of guide the groove, the extension thread guided by the guide groove contacts one of the knife sections whereby the thread end can be surely cut.

Although the invention has been described in its preferred form with a certain degree of particularity, it is to be understood that many variations and changes are possible in the invention without departing from the scope thereof.

What is claimed is:

1. A cloth presser adapted for use in a sewing machine stitching in zigzag and comprising:

a cloth presser supporting having upper and lower ends;

a cloth presser bottom plate adapted to be moved in a cloth feeding direction, the plate having front and rear ends and being pivotally mounted on the lower end of the supporter in a region adjacent the rear end of the plate, the plate having an L shaped slot, one leg of the slot being disposed intermediate the front and rear ends and disposed at right angles to said direction, the other leg of the slot extending rearwardly from the said one leg at right angles thereto, the one leg being designated as a needle location groove, the other leg being designated as a needle thread guide, the region at which the side wall of the one leg remote from the front end of the plate intersects the corresponding side wall of the other leg defining a corner, said plate also being provided with a flat knife receiving groove adjacent the rear end of the plate, said knife groove extending parallel to but spaced rearwardly from the needle location groove, said knife groove having a selected depth;

a thread holder for holding an end of a thread which has been previously passed through a hole in a needle at a vertical separation with respect to the plate such that said thread when extended between the thread end held by the holder and the first zigzag stitch of said thread does not extend over the corner; and a flat knife disposed in said groove and secured to said plate, the thickness of the knife being equal to the depth of said knife groove.

2. The presser of claim 1 wherein said corner is rounded and said knife has a bore extending through the thickness thereof, the presser further including a screw extending through the bore into the plate to secure the knife in position.

3. The presser of claim 2 wherein the knife is composed of two adjacent knife sections which together form a V shaped cutting edge which extends across the needle thread guide to sever the thread.

* * * * *